US005931708A

United States Patent [19]

Annas et al.

[11] Patent Number: 5,931,708

[45] Date of Patent: Aug. 3, 1999

[54] MULTI-TAP STUD CONNECTOR

[75] Inventors: Nick S. Annas, Red Hook; Robert A. Nellis, Jr., Staatsburg, both of N.Y.

[73] Assignee: Hubbell Incorporated, Orange, Conn.

[21] Appl. No.: 08/925,176

[22] Filed: Sep. 9, 1997

Related U.S. Application Data

[60] Provisional application No. 60/026,115, Sep. 13, 1996.

[51] Int. Cl.[6] ..... H01R 11/09

[52] U.S. Cl. ..... 439/798; 439/724

[58] Field of Search ..... 439/796, 797, 439/798, 723, 724, 729

[56] References Cited

U.S. PATENT DOCUMENTS

| | | | |
|---|---|---|---|
| D. 302,420 | 7/1989 | McGrane | 439/798 |
| D. 320,381 | 10/1991 | McGrane | 439/798 |
| 2,943,294 | 6/1960 | Norden | 439/798 |
| 3,133,779 | 5/1964 | Stanback | 439/798 |
| 3,725,851 | 4/1973 | Linn | 439/798 |
| 3,732,530 | 5/1973 | Linn et al. | 439/798 |
| 3,794,963 | 2/1974 | Cooper, Jr. | 439/798 |
| 4,214,806 | 7/1980 | Kraft | 439/620 |
| 4,547,627 | 10/1985 | McGrane | 439/796 |

FOREIGN PATENT DOCUMENTS

| | | |
|---|---|---|
| 1116294 | 11/1961 | Germany . |
| 1244906 | 7/1967 | Germany . |

OTHER PUBLICATIONS

Preformed Line Products, The New Conpact Connector Brochure, copyright 1995, two pages.

Fargo Mfg. Co., Inc. Catalog, Universal In–Line Dead Front Multi–Tap Stud Connector, Dec. 1988, pp. 3 and 4.

Fargo Mfg. Co., Inc. Catalog, Aluminum Multi–Tap Stud Terminal Connectors and Protective Boots, Oct. 1990, pp. 5 and 6.

Four photographs showing a Homac Protective Cover.

*Primary Examiner*—Neil Abrams
*Assistant Examiner*—T C Patel
*Attorney, Agent, or Firm*—Jerry M. Presson; David L. Tarnoff; Thomas P. Hilliard

[57] ABSTRACT

A connector has an attaching portion with a first axis extending in a first direction, a first free end adapted to receive a mating connection element, and a second end spaced from the first free end along the first axis. The connector further has first and second arm portions coupled to the second end of the attaching portion and extending outwardly therefrom. Each of the arm portions has a second longitudinal axis extending transverse to the first axis of the attaching portion. Each of the first and second arm portions further has a plurality of ports for receiving conducting devices or conductors, each of the ports being open towards a direction that is transverse to the second longitudinal axis. Preferably, the first and second arm portions and the attaching portion are integrally formed as a unitary, one-piece member. The connector further has a plurality of fastening members, with each of the fastening members being coupled to one of the plurality of ports for securing one of the conducting devices or conductors within each of the ports. Each of the first fastening members having a first actuating element that is accessible for manipulation in a direction that is transverse to the second longitudinal axis. A non-conductive cover can be used to surround and insulate the connector.

35 Claims, 11 Drawing Sheets

MULTI-TAP STUD CONNECTOR

This Application claims the benefit of U.S. Provisional Application Ser. No. 60/026,115, filed Sep. 13, 1996.

FIELD OF THE INVENTION

The present invention relates to the field of electric power distribution, and, more specifically, to multi-tap stud connectors for attaching two or more conductors to a stud protruding through the wall of a transformer well of a pad-mounted transformer. Additionally, the invention relates to a non-conductive cover for use with such connectors.

BACKGROUND OF THE INVENTION

Transformers are common and necessary components in electric power distribution networks. Generally, electric power is distributed from electrical substations at high voltage typically in excess of 6,000 volts to minimize losses. Transformers are required to step the voltage down to lower levels, such as 120 volts, for local distribution to commercial and residential customers.

A transformer commonly used for this purpose is housed in a steel cabinet on a concrete platform or pad at ground level. The transformer itself includes primary and secondary coils housed in an oil-filled transformer well, the oil being provided to keep the coils cool. Studs, to which conductors carrying high voltage power to the primary coils, and to which conductors carrying stepped down voltage from the secondary coils, may be attached, protrude laterally outward from the transformer through the wall of the transformer well.

The studs are insulated from the wall of the transformer well by an insulating bushing or seal, which must be impermeable to the oil filling the transformer well. There are generally five studs, two for attaching incoming conductors to the primary side and three for attaching outgoing conductors to the secondary side. Three studs are required on the secondary side, one for each of two phases and one for a return or ground conductor.

Transformers of this type may be used to deliver electric power to a relatively small number of end consumers. To supply each such consumer, one conductor from each of the three studs on the secondary side of the transformer is required. Typically, then, a number of conductors is connected to each of the studs, one for each of the consumers being served.

Multi-tap stud connectors are used to attach the conductors individually to the studs. A common connector may be considered to be an extension of the stud itself, as it is attached to the stud and extends laterally outward from the wall of the transformer well. A plurality of conductor ports, arranged axially along this type of connector, are directed perpendicularly to the axis of the connector. Each conductor port has its own set screw for securing a conductor therein. These, too, are arranged axially along one side of the connector.

Perhaps the most serious shortcoming of this type of connector is the moment, or torque, it places on the stud when conductors are secured into the conductor ports. It is quite common for this moment to cause the bushing or seal separating and insulating the stud from the wall of the transformer well to fail. The most common result of such failure is oil leakage from the transformer well.

Another serious shortcoming is the relative inaccessibility of the conductor ports closest to the stud on the connector.

To reach a set screw for a conductor port axially closest to the stud along the conductor, the electrician must reach in toward the stud over a number of conductors. Worse still, the inner set screws may not be readily visible, forcing the electrician to work blindly. And, as the three studs are often arranged one above the other on the wall of the transformer well, the electrician may often be required to reach between two layers of conductors to adjust the set screw of a conductor attached close to a stud.

Attempts have been made to address these problems. One such attempt is known as the Z-Bar connector because of its Z-shaped cross section. Such a connector is manufactured by Preformed Line Products under the name CONPACT Connector. Like the above-described connector, it may be considered to be an extension of the stud itself, because it is attached to the stud and extends laterally outward from the wall of the transformer well. In the Z-Bar connector, however, conductor ports are arranged axially therealong in two tiers, each conductor port again being directed perpendicularly to the axis of the connector, and each having a set screw on one side of the connector. The Z-bar connector permits the same number of conductors to be attached to the stud in one-half of the lateral distance, thereby reducing the moment applied to the stud by half, although the accessibility problems discussed above are somewhat reduced, but remain serious.

Commonly, multi-tap stud connectors have non-conductive covers to insulate the connectors from other connectors and the electrician. Prior art covers have generally been one-piece, rubber-like covers made from a plastisol, and fit over the connectors in a manner similar to that of a sock. However, these prior art covers are only appropriate for the prior art connectors. Since the prior art connectors are axial extensions of the transformer stud, they readily accept a sock-like cover that is applied axially. However, the sock-like prior art covers offer little versatility and are not useful for connectors having elements that are transverse to each other.

Although, a basic, rubber-like two-piece cover is known in the art for surrounding Z-Bar-type connectors, it does not overcome all of the limitations of the sock-like covers. Most importantly, the prior two-piece cover fails to provide a strong attachment between the two pieces.

An example of a prior art multi-tap stud connector and cover is disclosed in U.S. Pat. No. 4,214,806 to Kraft. Examples of prior art connectors for multiple connections are disclosed in U.S. Pat. No. 2,943,294 to Norden; and in foreign patent documents: DE 1116294 to Eigirt; and DE 1244906 to Hensel.

Thus, there is a continuing need to provide improved multi-tap stud connectors and non-conductive covers therefor. The present invention represents a novel approach toward a solution of the problems involved in connecting many conductors to the studs on a transformer and providing covers for such connectors. This invention addresses this need in the art along with other needs that will become apparent to those skilled in the art from this disclosure.

SUMMARY OF THE INVENTION

One object of the invention is to provide a multi-tap stud connector that facilitates access to the connector.

Another object of the invention is to provide a multi-tap stud connector that reduces moments applied by the connector on a stud.

Yet another object of the present invention is to provide a multi-tap stud connector wherein first and second arms having a plurality of conductor ports are arranged transversely with respect to the axis of its stud port, so that any cantilever stress or moment it may apply to the stud when one or more conductors are attached thereto may be minimized. The first and second arms may be offset relative to the stud port to permit conductors to be trained into the conductor ports in layers when studs are closely spaced on the transformer. The transverse orientation of the arms, most importantly, permits the set screws used to tighten the conductors into the conductor ports to face outward, where they may be easily seen and readily accessed.

Still another object of the invention is to provide a non-conductive cover for a connector.

Yet another object of the invention is to provide a non-conductive cover for a multi-tap stud connector having elements that are transverse to each other.

A further object of the invention is to provide a two-piece non-conductive cover for a connector that securely enclosing a connector while providing access to the elements of the connector.

The foregoing objects are basically obtained by providing a connector comprising an attaching portion having a first axis extending in a first direction, a first free end adapted to receive a mating connection element, and a second end spaced from the first free end along the first axis, and a first arm portion coupled to and extending from the second end of the attaching portion and having a second longitudinal axis extending transversely to the first axis of the attaching portion, the first arm portion further having a plurality of first ports for receiving conducting devices, each of the first ports being open towards a second direction that is transverse to said second longitudinal axis, and the first arm portion and the attaching portion being integrally formed as a unitary, one-piece member, and a plurality of first fastening members, each of the first fastening members being coupled to one of the plurality of first ports for securing one of the conducting devices within each of the first ports, each of the first fastening members having a first actuating element that is accessible for manipulation in a third direction that is transverse to the second longitudinal axis.

The foregoing objects are further obtained by providing an electrical connecting assembly comprising a transformer connection element protruding from a transformer, the connection element having a first longitudinal axis extending in a first direction, a base end, and a projecting free end; and a connector coupled to the connection element and having an attaching portion and a first arm portion, the attaching portion being fastened to the free end of the connection element and the first arm portion being coupled to and extending from the attaching portion and having a second longitudinal axis, extending transversely to the first longitudinal axis of the connection element, the first arm portion further having a plurality of first ports for receiving connecting devices, each of the plurality of first ports being open towards a second direction transverse to the second longitudinal axis, and a plurality of first fastening members, each of the plurality of first fastening members being coupled to one of the plurality of first ports for securing one of the connecting devices within each of the plurality of first ports, each of the first fastening members having a first actuating element that is accessible for manipulation in a third direction that is transverse to the second longitudinal direction.

The forgoing objects are still further obtained by providing a non-conductive cover comprising a first member having a first base and a first perimeter wall extending from and around the first base, the first perimeter wall having at least one aperture extending completely therethrough, the at least one aperture being at least partially defined by a first end portion of the first perimeter wall that faces the first base, and a second member having a second base and a second perimeter wall extending from and around the second base, the second perimeter wall having a second interior surface and a second exterior surface with at least one coupling assembly comprising a projection and an opening in the perimeter wall, the projection having a first side facing towards and spaced from the second base and the opening extending completely through the perimeter wall and located between the second base and the first side of the projection, the first member receiving the second member when the cover is in a closed position such that the second perimeter wall extends within the first perimeter wall and the projection being positioned within the at least one aperture, the first side of the projection being spaced from the first end portion of the first perimeter wall to permit access through both the first and second perimeter walls through a first hole formed by aligned portions of the first opening and the at least one aperture, and a cavity being formed between the first and second bases in said closed position.

The forgoing objects are still further obtained by providing a connecting assembly comprising a connector having an attaching portion and a first arm portion, the attaching portion having a first axis extending in a first direction, a first free end adapted to receive a mating connection element, and a second end spaced from the first free end along the first axis, the first arm portion coupled to and extending from the second end of the attaching portion and having a second longitudinal axis extending transversely to the first axis of the attaching portion, the first arm portion further having a plurality of first ports for receiving conducting devices, each of the first ports being open towards a second direction that is transverse to the second longitudinal axis, and the first arm portion and the attaching portion being integrally formed as a unitary, one-piece member, the connector further having a plurality of first fastening members, each of the plurality of first fastening members being coupled to one of the plurality of first ports for securing one of the conducting devices within each of the plurality of first ports, each of the plurality of first fastening members having a first actuating element that is accessible for manipulation in a third direction that is substantially transverse to the second longitudinal axis and a non-conductive cover having first and second members that surround the connector when the cover is in a closed position, the first and second members being distinct and separate members that couple together to form a plurality of first holes when the cover is in the closed position, each of the plurality of first holes extending completely through a portion of the first and the second members and being aligned with one of the first fastening members, the first member also having a plurality of second holes, each of the plurality of second holes being aligned with one of the plurality of first ports.

Other objects, advantages, and salient features of the invention will become apparent from the following detailed description, which, taken in conjunction with the annexed drawings, discloses preferred embodiments of the invention.

BRIEF DESCRIPTION OF THE DRAWINGS

Referring now to the attached drawings that form a part of this disclosure.

DETAILED DESCRIPTION OF THE INVENTION

Figure 1:
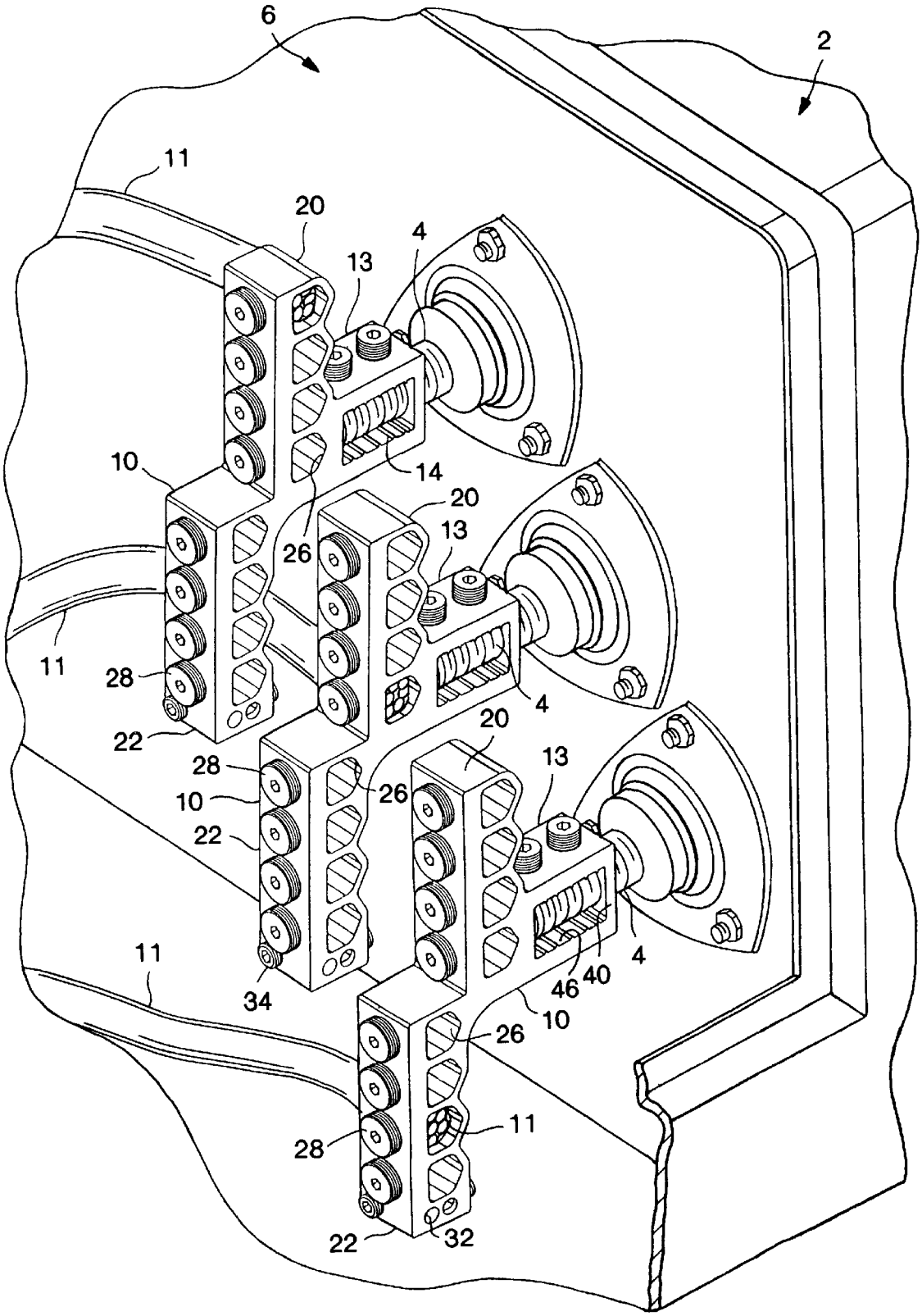
FIG. 1 is a front side perspective view of three multi-tap stud connectors in accordance with the present invention, with the connectors being attached to each of three studs of a transformer with a conductor attached to each of the stud connectors.
Figure 2:
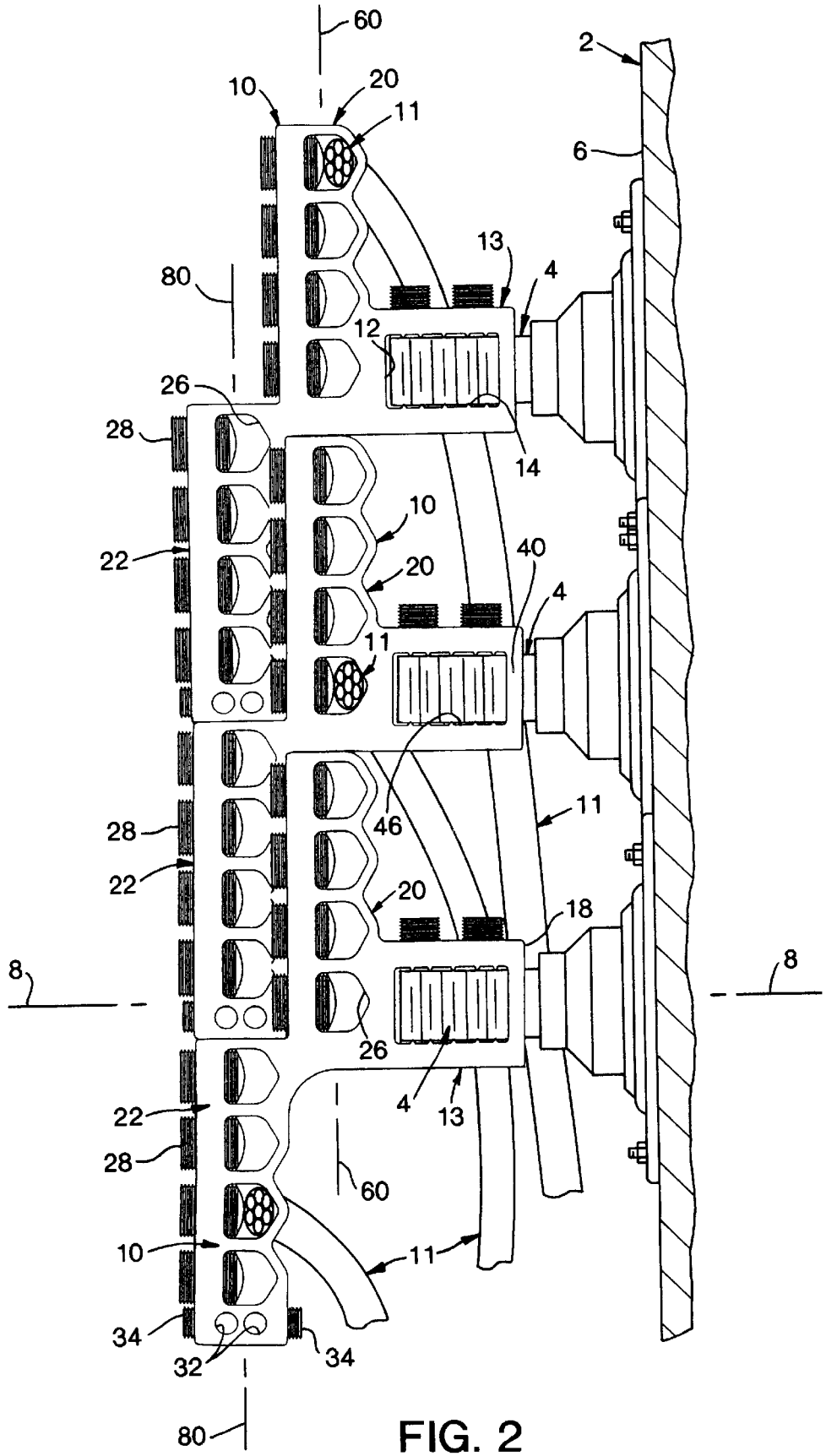
FIG. 2 is a side elevational view of the three connectors in accordance with the present invention and attached to a transformer as illustrated in FIG. 1.
Figure 3:
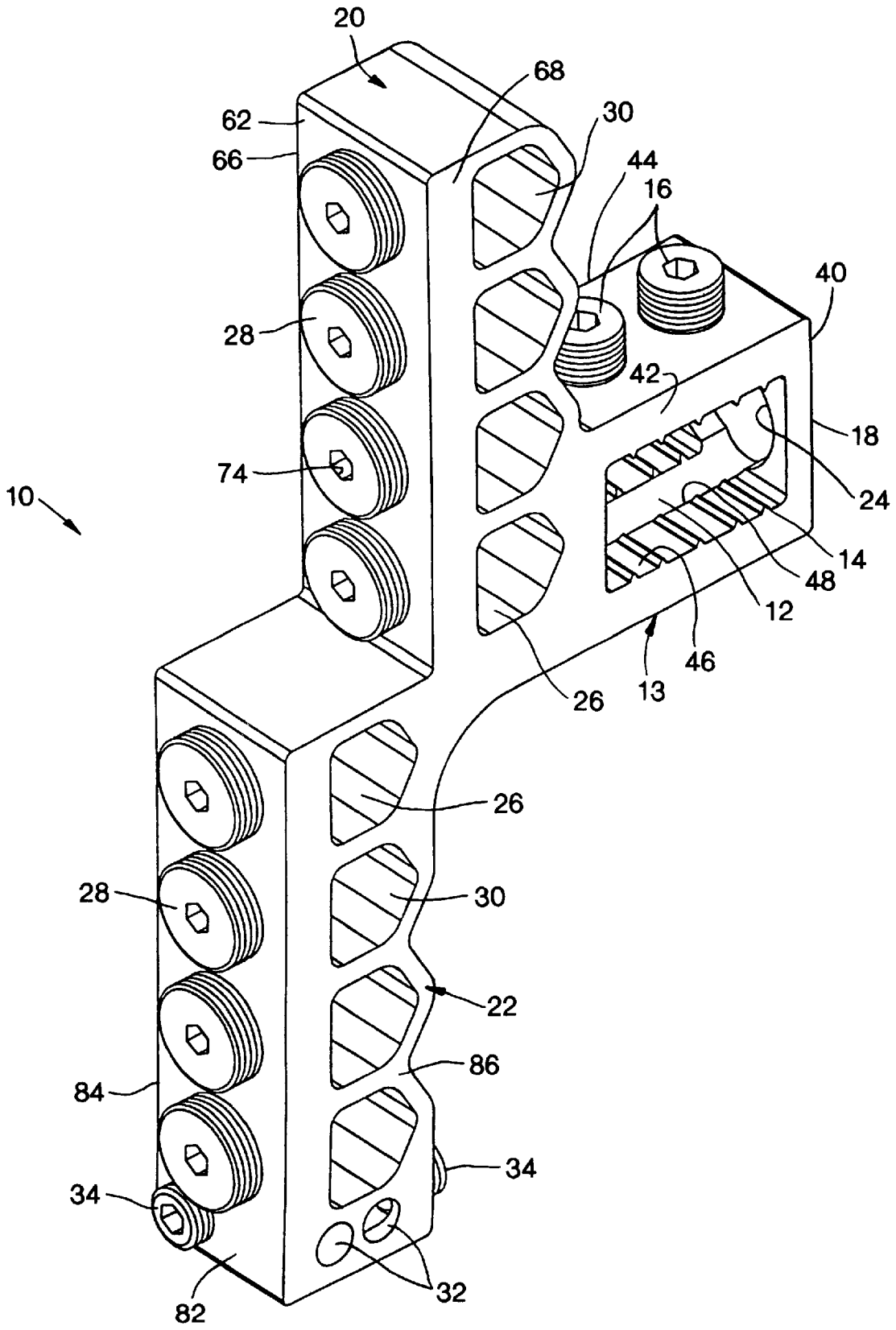
FIG. 3 is a front side perspective view of the connector in accordance with the present invention.

As seen in FIGS. 1 and 2, three multi-tap stud connectors 10 in accordance with the present invention are attached to a transformer 2. An electrical conductor 11 is attached to each connector 10. Each conductor 11 ultimately provides electricity from transformer 2 to an end user. Each connector 10 increases the number of conductors 11 that can be attached to transformer 2, and thus, increases the number of end users that can be serviced by transformer 2.

Transformer 2 is a conventional transformer as is known in the art, and therefore, will only be briefly described herein. Transformer 2 has three transformer studs 4 located on its secondary side and extending from a transformer wall 6. Each stud 4 is generally cylindrical with its base coupled to transformer wall 6, and with its free end protruding away from wall 6. Each stud 4 has a longitudinal axis 8 that extends substantially perpendicularly from transformer wall 6. Typically, studs 4 are threaded studs that are made in two thread sizes, ⅝ inch-11 or 1 inch-14, depending on the particular application and the particular transformer to which they are attached.

Conductors 11 are known electrical cables that are commonly used as attachments to multi-tap stud connectors for providing electricity from a transformer to an end user. Thus, conductors 11 will not be discussed in detail herein.

Referring to FIGS. 1–5, each of the multi-tap stud connectors 10 has an attaching portion 13 with two set screws 16, a first or upper arm 20 with four set screws 28 and a second or lower arm 22 with four set screws 28, two smaller set screws 34. Although attaching portion 13, upper arm 20, and lower arm 22 can be made as separate elements coupled together, preferably, these elements are integrally formed as a unitary, one-piece member made from metallic material, such as aluminum. Specifically, 6061-T6 aluminum is preferred. Alternatively, attaching portion 13, upper arm 20, and lower arm 22 can be made from any material that multi-tap stud connectors are typically formed from, or any material that adequately conducts electricity to the levels desired.

Figure 4:
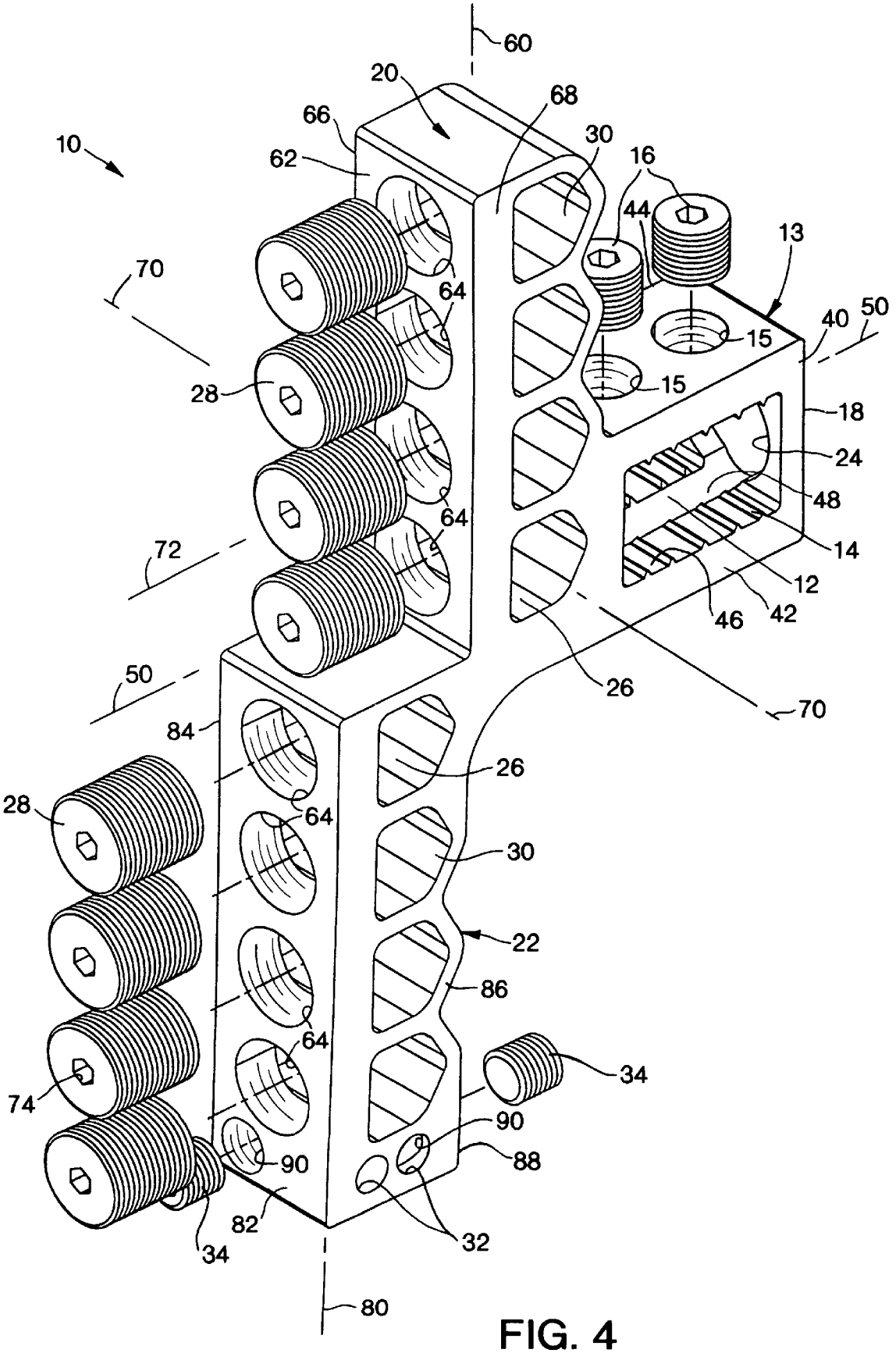
FIG. 4 is an exploded, front side perspective view of the connector in accordance with the present invention and as illustrated in FIG. 3.

As best seen in FIG. 4, attaching portion 13 has a free end 18, a stud port 12 extending along an axis 50 and a pair of set screw ports 15 for threadedly receiving set screws 16 therein. Attaching portion 13 is configured to accept a single stud 4 and rigidly attach connector 10 thereto.

Free end 18 has a substantially planar section or plate 40 that is intended to be substantially parallel to transformer wall 6 when connector 10 is attached to stud 4. Plate 40 has a stud hole 24 extending completely therethrough that is sized to receive stud 4. Stud hole 24 also provides access through plate 40 to stud port 12. Thus, longitudinal axis 8 of stud 4 is collinear with axis 50 of attaching portion 13 when connector 10 is attached to stud 4.

Stud port 12 is a through slot that extends completely through attaching portion 13 between sides 42 and 44. Stud port 12 provides the receiving area for stud 4 as it is inserted into connector 10 through stud hole 24. A bottom side 46 of the inner surface of stud port 12 has a plurality or row of teeth 14. During use, connector 10 is disposed on transformer stud 4 using stud hole 24. Stud 4 protrudes through stud hole 24 and into stud port 12 where it is held by set screws 16 that are tightened to secure connector 10 to teeth 14.

Stud port 12 is enlarged adjacent bottom side 46 by a channel 48 that extends the entire length of stud port 12 and through plate 40 and parallel to axis 50. Channel 48 is partially cylindrical and has a cross-sectional radius that is smaller than both the radius of stud 4 and the radius of stud hole 24. Teeth 14 on bottom side 46 extend on both sides of channel 48 in a direction that is substantially perpendicular to axis 50. Teeth 14 and channel 48 are arranged such that when stud 4 is inserted into stud port 12 through stud hole 24, the edges of teeth 14 adjacent channel 48 will contact stud 4. More specifically, the edges of teeth 14 adjacent channel 48 are intended to be positioned within the grooves that exist between the threads on stud 4. Accordingly, teeth 14 are appropriately spaced to coincide with the particular groove spacing on stud 4. Thus, teeth 14 will be spaced differently depending on whether the stud intended to be received in stud port 12 is a ⅝ inch-11 stud or a 1 inch-14 stud.

Set screw ports 15 are cylindrical threaded openings extending through attaching portion 13 to provide access for corresponding set screws 16. Set screw ports 15 are positioned to enable set screws 16 to contact stud 4 in a manner such that stud 4 is forced against teeth 14 adjacent either side of channel 48 while set screws 16 are tightened on stud 4. Thus, set screws 16 rigidly attach connector 10 to stud 4 and insure a reliable connection by forcing teeth 14 within the grooves of stud 4. This particular method of attaching connector 10 to stud 4 through the use of teeth 14, channel 48, and a set screw 16 is known in the art and disclosed in U.S. Pat. No. 4,214,806 to Kraft issued Jul. 29, 1980. Accordingly, U.S. Pat. No. 4,214,806 to Kraft, is hereby incorporated herein by reference.

Set screw ports 14 extend through attaching portion 13 in a direction that is substantially perpendicular to axis 50. Thus, set screws 16 apply a retaining force on stud 4 in a direction that is substantially perpendicular to longitudinal axis 8 of stud 4. Set screws 16 are conventional set screws that are known in the art and that have an actuating portion on one end that receives a conventional tool, such as an Allen wrench. Set screws 16 are preferably arranged so that the actuating tool can be inserted in a direction that is substantially perpendicular to axis 50 and longitudinal axis 8.

Although two set screws 16 are employed in the embodiment of connector 10 illustrated in FIGS. 1–5, it should be understood that one set screw port 15 and one corresponding set screw 16 can be employed if desired.

Upper arm 20 has a longitudinal axis 60, a front 62 with four set screw ports 64 for threadedly receiving set screws 28 therein and two sides 66 and 68 with four conductor ports 26 extending therebetween. Each conductor port 26 is capable of receiving a conductor 11 therein. Conductors 11 are retained in ports 26 by a corresponding set screw 28 which is threaded through its set screw port 64 to engage conductor 11 and secure it within conductor port 26. This arrangement results in a sturdy electrical connection between connector 10 and conductor 11.

Upper arm 20 extends from attaching portion 13 opposite plate 40 along an upper arm longitudinal axis 60 in a direction that is transverse to axis 50. Preferably, longitudinal axis 60 is substantially perpendicular to axis 50 so that it will be substantially perpendicular to longitudinal axis 8 of stud 4 when in use.

Each conductor port 26 on upper arm 20 extends completely therethrough between sides 66 and 68 in a direction that is transverse to longitudinal axis 60. Preferably, each conductor port 26 has an axis 70 that extends substantially perpendicularly to both longitudinal axis 60 of upper arm 20 and axis 50 of attaching portion 13. Each of the conductor port axes 70 are preferably parallel to each other to facilitate access to each conductor port 26.

Figure 5:
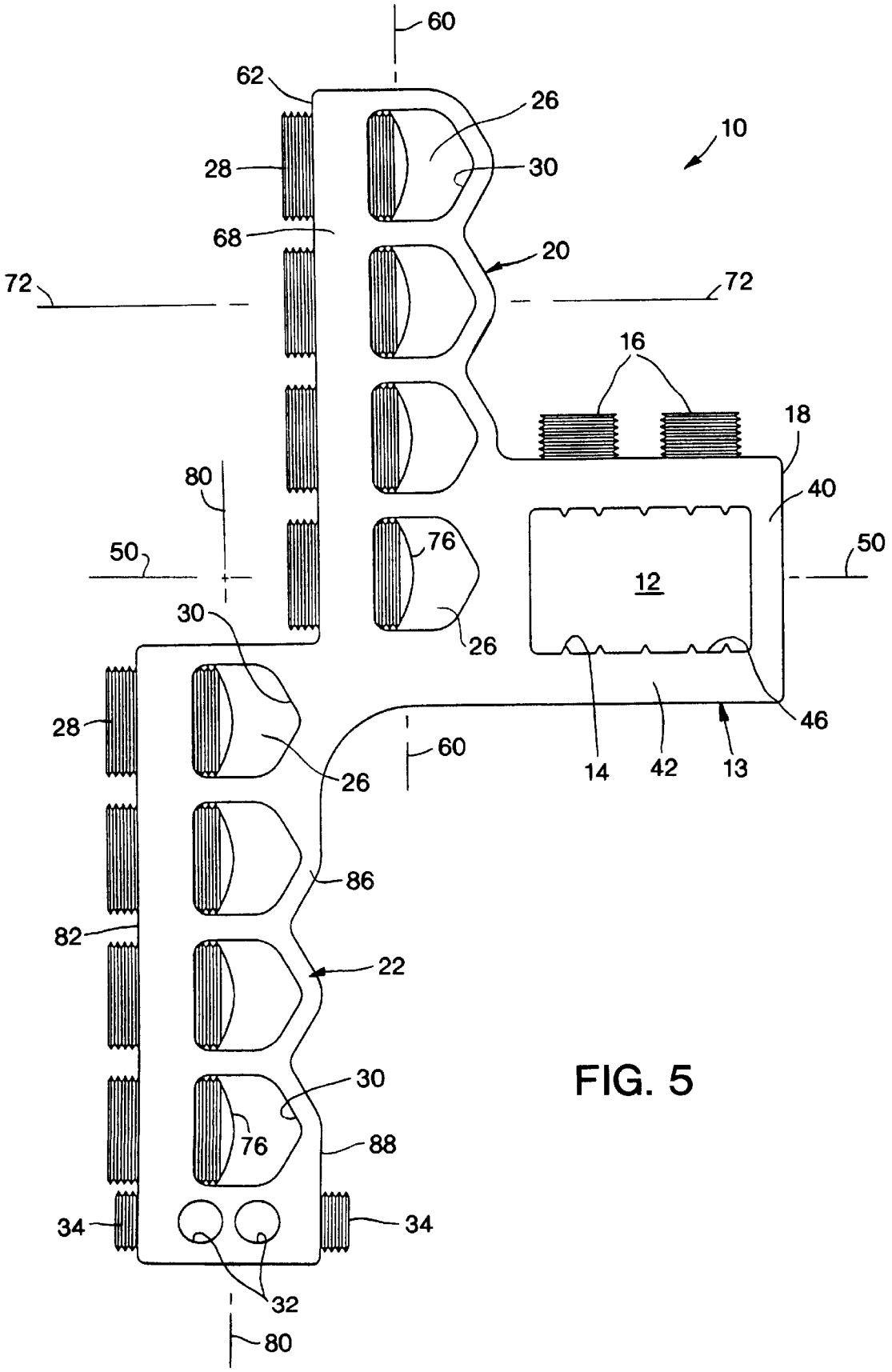
FIG. 5 is a side elevational view of the connector in accordance with the present invention and as illustrated in FIGS. 3 and 4.

As seen in FIG. 5, conductor ports 26 are generally rectangular in cross-section except for a back side 30. Back side 30 of the conductor ports 26 facing set screws 28 may be generally V-shaped, as shown, and may be provided with teeth, such as teeth 14 in stud port 12. This provides an improved connection between conductor 11 and port 26. It should be understood that conductor ports 26 can take any shape that adequately receives an appropriate conductor 11. Conductor ports 26 are preferably sized to accept conductors 11 within the range of #6-500KCMil.

As seen in FIGS. 1–5, upper arm 20 has four conductor ports 26 extending therethrough. It should be understood that upper arm 20 can have any reasonable number of conductor ports 26, preferably upper arm 20 has either two or four conductor ports 26.

Set screw ports 64 are similar to set screw ports 15 discussed above but are generally larger in diameter for receiving larger set screws 28. Each set screw port 64 has an axis 72 that is transverse to longitudinal axis 60. Preferably, each axis 72 is substantially perpendicular to longitudinal axis 60 and substantially parallel to other set screw port axes 72 to facilitate access to set screws 28. Each set screw port 64 extends from front 62 through upper arm 20 to the conductor port 26 to which it corresponds.

Each set screw 28 can be threaded into a corresponding set screw port 64 towards a back side 30 of the corresponding conductor port 26. In use, each set screw 28 is threaded into its corresponding set screw port 64 until contacting a conductor 11 that has been positioned with the conductor port 26. Set screw 28 then forces conductor 11 against back side 30 until a secure coupling has occurred between conductor 11 and conductor port 26.

Set screws 28 are commonly used set screws, and therefore, will not be described in great detail herein. As best seen in FIGS. 2 and 5, set screws 28 have an actuating portion or recess 74 at one end and preferably a rounded tip 76 at the other end as is known in the art. Recess 74 receives a conventional tool such as an Allen wrench.

Set screw ports 26 are preferably aligned such that the recess 74 of each set screw 28 is in a direction that is parallel to or collinear with axis 50. Thus, when connector 10 is disposed on stud 4, each recess 74 faces outward from wall 6 of a transformer well. As such, set screws 28 are readily accessible to an electrician.

Although set screws such as set screws 16, 28 and 34 are common in the art and commonly used with multi-tap stud connectors, it should be understood that any acceptable fastening member can be employed in place of set screws. Acceptable fastening members can be any member that adequately secures conductors 11 to connector 10 and connector 10 to stud 4 while maintaining a sufficient conductivity from stud 4 to conductors 11.

Lower arm 22 is substantially identical to upper arm 20, except for its positioning on connector 10 and its capability of accommodating some additional electrical connections. Like upper arm 20, lower arm 22 has a longitudinal axis 80, a front 82 with four set screw ports 64 for threadedly receiving set screws 28 therein and two sides 84 and 86 with conductor ports 26 extending therebetween. Also, lower arm 22 has additional conductor ports 32, and additional set screw ports 90 with corresponding additional set screws 34.

Conductor ports 26, and set screw ports 64 with corresponding set screws 28 located on lower arm 22 are substantially identical to those discussed above with respect to upper arm 20 in structure, orientation and function, and therefore, will not be discussed in detail with respect to lower arm 22.

Lower arm 22 is integrally attached to the bottom of upper arm 20, and spaced further from attaching portion 13 than upper arm 20. Longitudinal axis 80 of lower arm 22 is spaced from and substantially parallel to longitudinal axis 60 of upper arm 20. Thus, first arm 20 and second arm 22 are offset from one another at staggered distances from stud port 12. This feature permits all three studs 4 on transformer 2 to be provided with a connector 10, and permits conductors 11 attached to them to be brought into connectors 10 in layers.

Although lower arm 22 can be identical to upper arm 20, lower arm 22 preferably differs from upper arm 20 in that additional conductor ports 32 are provided at the end of lower arm 22 for grounding or street light purposes. Additional conductor ports 32 are generally circular in cross section and each is smaller than conductor ports 26. Therefore, additional conductor ports 32 permit only a smaller range of conductor to be inserted therein. Since they are sized to receive conductors for street lighting or for grounding purposes, additional conductor ports 32 are preferably sized to receive conductors in a range of#10-#1AWG.

In order to securely fasten conductors within additional conductor ports 32, front 82 and rear 88 each have an additional threaded set screw port 90 with corresponding set screws 34. One additional set screw port 90 is located on front 82 and leads to one additional conductor port 32, and another additional set screw port 90 is located on rear 88 and leads to the other additional conductor port 32. Additional set screw ports 90 are oriented such that set screws 34 access additional conductor ports 32 in a direction that is substantially parallel to the direction that set screws 28 access conductor ports 26.

FIGS. 1 and 2 illustrate the preferred orientation of connectors 10 with respect to studs 4 when these elements are attached together. Longitudinal axis 8 of each stud 4 is preferably collinear with axis 50 of its respective attaching portion 13. Thus, each connector 10 is oriented to enable conductors 11 to be inserted in a direction that is substantially perpendicular to longitudinal axis 8. More importantly, this orientation allows set screws 28 to be actuated and manipulated by an electrician in a direction that is either substantially parallel to or collinear with longitudinal axis 8. In other words, the tool used to tighten set screws 28 can be applied in a direction that is substantially perpendicular to wall 6 of transformer 2 and substantially parallel to studs 4 enabling an electrician to more easily connect and disconnect conductors 11 to connectors 10.

Referring to FIG. 2, the lateral offset of upper arm 20 and lower arm 22 that results in their respective longitudinal axis 60 and 80 being spaced and substantially parallel results in a more versatile connector 10. That is, connector 10 does not block or prohibit access to other connectors 10 when multiple connectors 10 are used on adjacent studs 4.

Upper and lower arms 20 and 22 are laterally offset so that when viewed from the side in the direction of inserting conductors 11 in conductor ports 26, as in FIG. 2, two unobstructed rows of conductors ports 26 are formed for each connector 10. If upper arm 20 and lower arm 22 were not offset, the spacing of studs 4 is such that the lower arm 22 of a first connector 10 positioned above a second connector 10 would obstruct the upper arm 20 of the second connector 10. Such an arrangement would necessitate conductors 11 approaching connectors 10 in two opposing directions. However, with the lateral offset between upper and lower arms 20 and 22, all conductors can approach connectors 10 in one direction making installation easier. Although, for simplicity, only one conductor 11 is illustrated as being attached to a single connector 10, every conductor port 26 in each connector 10 can accommodate a conductor 11 making the need for uniformity in installation imperative.

It will be readily appreciated that the moment placed on stud 4 to which connector 10 has been attached is much less than would be the case if the first and second arms 20 and 22 extended laterally outward in the direction of longitudinal axis 8 of stud 4 and stud port 12. In the subject invention, the moment arms for first and second arms 20 and 22 relative to stud port 12 are quite short, each being equal to the lateral distance separating each of the first and second arms 20 and 22 from stud port 12.

The present multi-tap stud connector 10 allows front access to set screws 28 for unequaled ease of initial, and subsequent, installation. The transverse orientation of upper and lower arms 20 and 22 having conductor ports 26 relative to stud port 12 maximizes the operating space for primary conductors 11. The lateral offset between upper and lower arms 20 and 22 of connector 10, and the ample spacing between conductor ports 26 along upper and lower arms 20 and 22 allows conductors 11 to be easily arranged and trained next to transformer 2. Most importantly, the transverse orientation of upper and lower arms relative to stud port 12 reduces cantilever stress on stud 4, protecting the stud connection and preventing breakage of transformer well seals. In summary, the present multi-tap stud connector 10, because of the orientation of its upper and lower arms 20 and 22 relative to stud port 12, places the least cantilever stress or moment on transformer stud 4 in comparison with prior-art connectors and provides the greatest accessibility to conductor ports 26 and their respective set screws 28.

Second Embodiment

Figure 6:
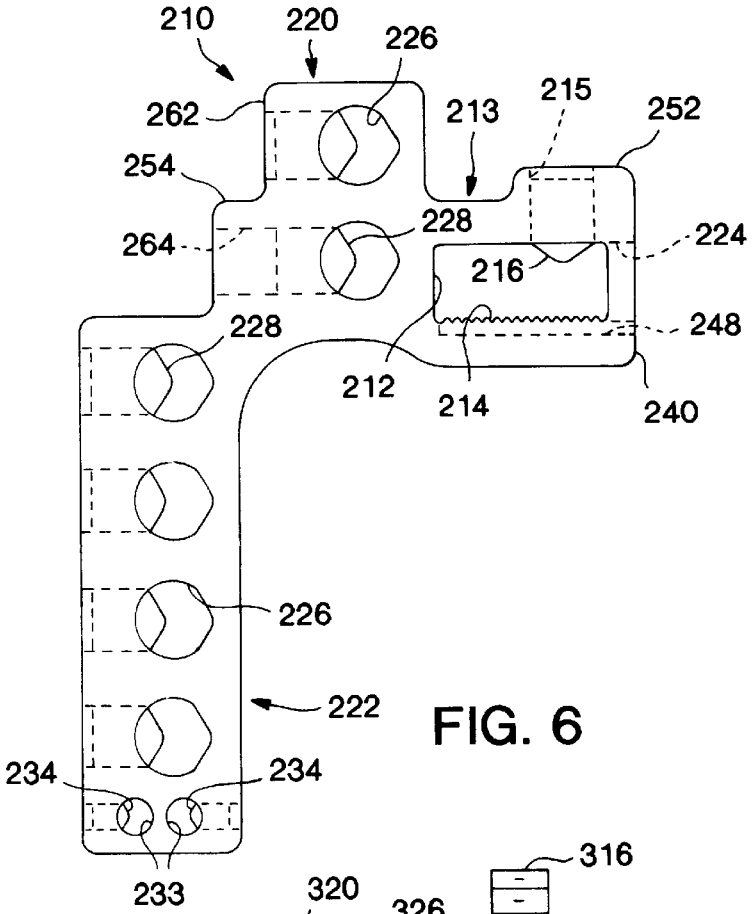
FIG. 6 is a side elevational view of a connector in accordance with a second embodiment of the connector of the present invention.

Referring now to FIG. 6, a multi-tap stud connector 210 in accordance with a second embodiment of the present invention is illustrated. Connector 210 has an attaching portion 213, and upper arm 220, and a lower arm 222. Connector 210 is substantially identical in structure and function to connector 10 as discussed above, except for the length of upper arm 220, the configuration of attaching portion 213, and the presence of a reinforcing area 254 between the upper and lower arms 220 and 222. Accordingly, only those portions of connector 210 that significantly differ from connector 10 will be discussed in any detail.

Thickened area 252 of attaching portion 213 is adjacent plate 240 and has a single set screw port 215 extending completely therethrough. Only a single set screw port 215 is necessary due to the extremely stable connection capable between stud 4 and attaching portion 213 through the use of teeth 214 and channel 248. Such a connection is discussed above with respect to connector 10.

Thickened area 252 allows a greater range of movement for the set screw 216 it receives within set screw port 215. This enables set screw 216 to be fully secured within set screw port 215 while having no contact with stud 4. Thus, set screw 216 can be completely disengaged with stud 4 and backed out of stud port 212, but still be securely within set screw port 215.

Upper arm 220 of connector 210 is shorter than upper arm 20 of connector 10 and, thus, only accommodates two conductor ports 226. It should be understood that connector 210 can be configured to have a longer upper arm 220 that has a greater number of conductor ports 226, for example, four conductor ports 226. Of course, upper arm 220 and lower arm 222, like upper and lower arms 20 and 22, are capable of being modified to receive any desired number of conductor ports 226.

Connector 210 further has a reinforcing area 254 located adjacent front 262 of upper arm 220, between upper arm 220 and lower arm 222. Reinforcing area 254 provides additional strength to the connection between upper arm 220 and lower arm 222. As a result of its size, reinforcing area 254 requires an increased length in the set screw port 264 extending therethrough. However, the set screw 228 extending through reinforcing area 254 is identical to the other set screws 28 corresponding to conductor ports 26.

Third Embodiment

Figure 7:
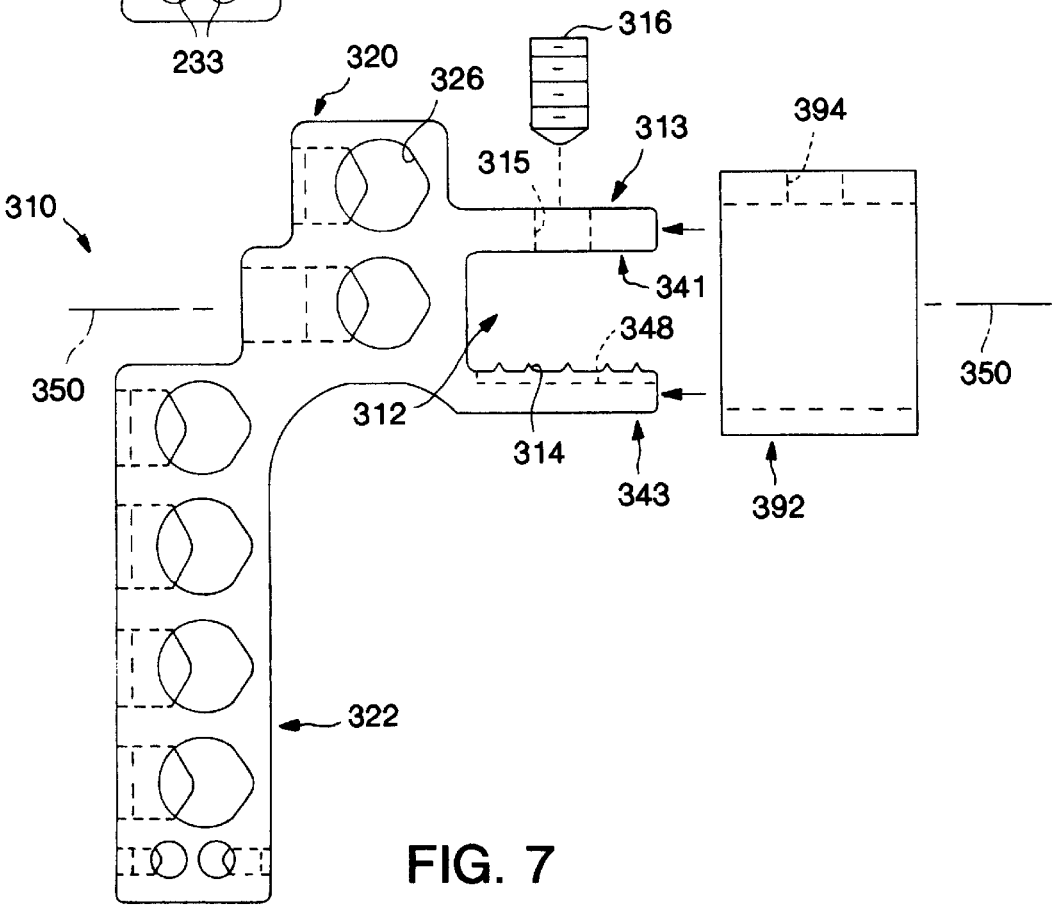
FIG. 7 is an exploded, side elevational view of a connector in accordance with a third embodiment of the connector of the present invention illustrating a set screw and collar detached from the connector.

As seen in FIG. 7, multi-tap stud connector 310 illustrates a third embodiment of the connector of the present invention. Connector 310 has an attaching portion 313, and upper arm 320, and a lower arm 322. Connector 310 is substantially identical in structure and function to connector 210 as discussed above except for the specific structure of attaching portion 313. Accordingly, only attaching portion 313 will be described in detail with respect to connector 310.

Attaching portion 313 differs from attaching portion 13 and 213 in that although it can receive the smaller ⅝ inch diameter stud 4, it is specifically intended to receive the larger 1 inch diameter stud 4. For this reason, connector 310 has an open stud port 312 structure to allow the larger stud 4 to be received more easily therein. Connector 310 functions without a plate 40 as in connector 10 and with only an upper flange 341 and a lower flange 343 forming attaching portion 313.

Except for being cantilevered from upper arm 320, upper and lower flanges 341 and 343 permit attaching portion 313 to function in much the same manner as attaching portion 13. Upper flange 341 has a set screw port 315 for receiving a set screw 316 therein for securing connector 310 to stud 4. Lower flange 343 has a row of teeth 314 for extending into the grooves of stud 4. Preferably, teeth 314 are arranged so that they will be aligned with grooves in the 1 inch-14 stud as discussed above. Also, lower flange 343 has a channel 348 extending along its entire length substantially identical to channels 48 and 248 discussed above.

Since upper and lower flanges 341 and 343 are cantilevered from the bottom of upper arm 320, it is preferred to use a collar 392 to provide additional support for flanges 341 and 343 when securely fastening connector 310 to stud 4. Collar 392 is hollow, generally rectangular in cross section, and sized so that it can extend completely around the outer extent of upper and lower flanges 341 and 343. Collar 392 is slid into position in a direction around upper and lower flanges 341 and 343 substantially parallel to axis 350. Thus, when engaged with attaching portion 313, collar 392 extends completely around attaching portion 313 in a direction substantially perpendicular to axis 350.

Collar 392 also has a threaded set screw port 394 that is aligned with set screw port 315 when collar 392 is completely positioned on attaching portion 313. This enables set screw 316 to extend through both collar 392 and upper flange 341 when being threaded to engage stud 4 in stud port 312.

Fourth Embodiment

Figure 8:
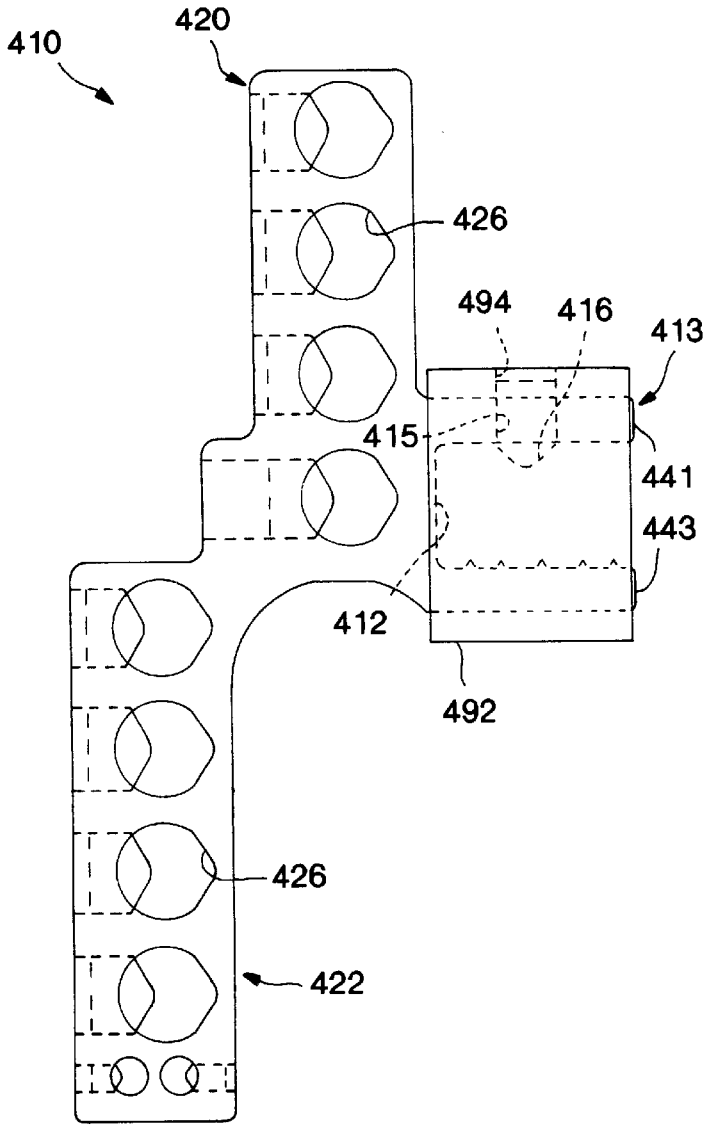
FIG. 8 is a side elevational view of a connector in accordance with a fourth embodiment of the connector of the present invention.
Figure 9:
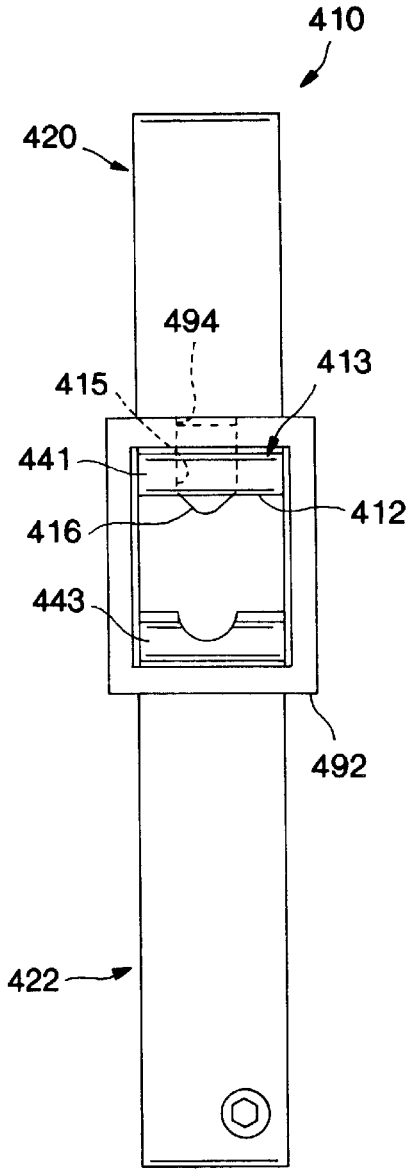
FIG. 9 is a rear elevational view of the connector in accordance with the fourth embodiment of the connector of the present invention as illustrated in FIG. 8.
Figure 10:
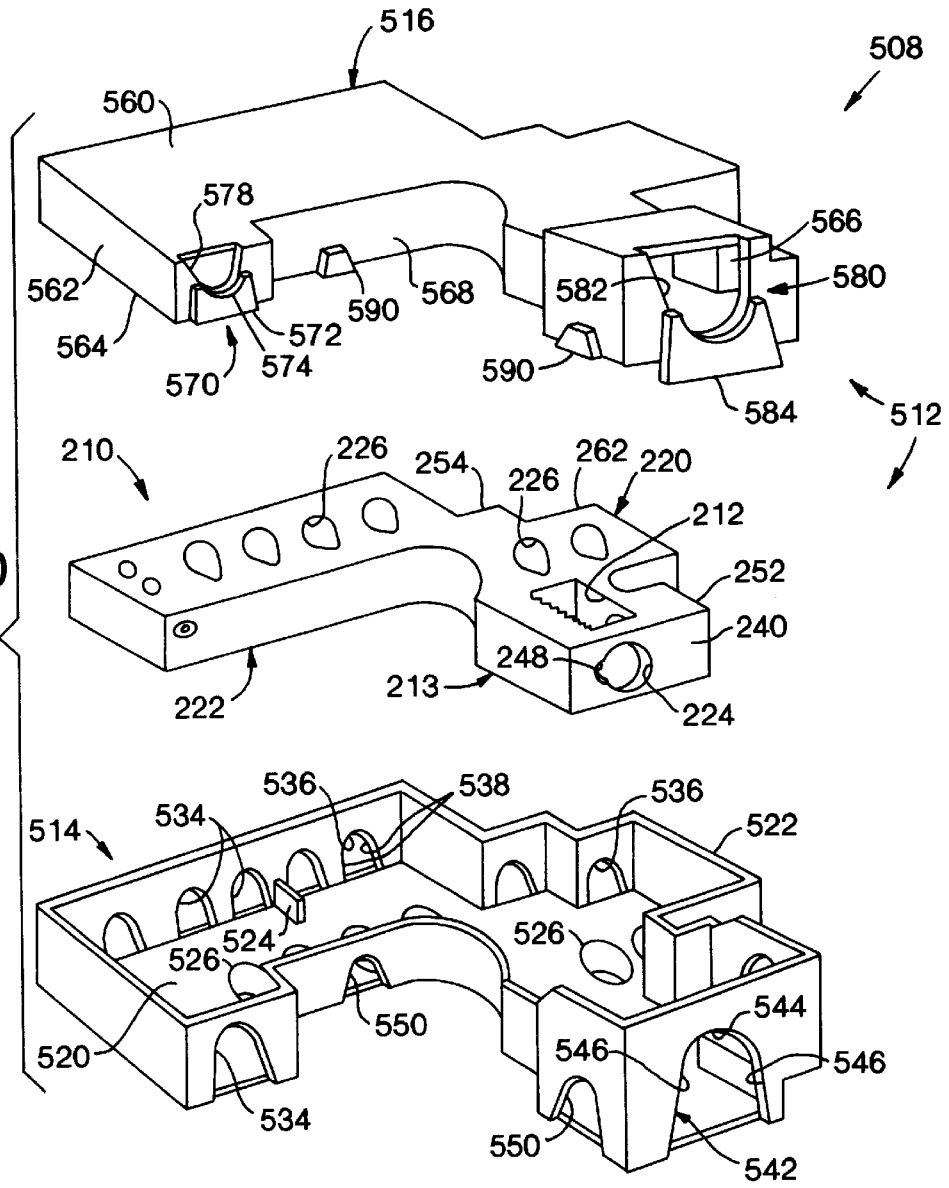
FIG. 10 is an exploded, front side perspective view of a connector assembly in accordance with the present invention illustrating the two halves of the non-conductive cover on either side of the connector in accordance with the second embodiment of the connector of the invention.

As seen in FIGS. 8 and 9, a multi-tap stud connector 410 is illustrated in accordance with a fourth embodiment of the connector of the present invention.

Connector 410 has an attaching portion 413, upper arm 420, a lower arm 422, and a collar 492. Collar having a threaded set screw port 416 aligned with set screw port 415 for enabling a set screw 416 to be threaded through collar 492 and upper flange 441 for engaging stud 4 in stud port 412. Connector 410 is substantially identical in structure and function to connector 310 as discussed above except for the length of upper arm 420 and the number of conductor ports 426 extending therethrough. Accordingly, only upper arm 420 will be described in any detail with respect to connector 410.

Upper arm 420 is illustrated with four conductor ports 426. Each conductor port 426 on upper arm 420 is substantially identical to conductor ports 26, 226 and 326 discussed above. If necessary or desired, upper arm 420, like the other disclosed upper and lower arms can be adapted to any length and can have any reasonable number of conductor ports 426 extending therethrough.

Non-Conductive Cover

Referring to FIGS. 10–17, a connector assembly 508 is illustrated comprising a non-conductive cover 512 for surrounding connector 210 and insulating connector 210 from other connectors and conductors, as well as from the electrician. Although cover 512 is adapted specifically to surround connector 210, it should be understood that covers similar to cover 512 can be formed to surround and insulate connectors other than connector 210 using the same basic configuration and features of cover 512. Since connector 210 is fully discussed above, it will not be discussed in detail with respect to cover 512.

Cover 512 basically comprises a female or receiving half 514 and a male or inserting half 516. Receiving half 514 and inserting half of 516 are each distinct, separate elements that are individually formed and then joined together when positioned around connector 210. Receiving half 514 and inserting half 516 are each integrally formed as unitary, one-piece members formed of a plastic material that is more rigid and dense than the previous rubbery, sock-like and two-piece covers known in the art, but still slightly resilient.

Preferably receiving and inserting halves 514 and 516 are formed of low density polyethylene that is capable of providing 600 volt insulation. Additionally, the preferred material for cover 512 is clear to enable an electrician to view connector 210 when it is positioned within cover 512. Of course, other materials may be used to form receiving and inserting halves 514 and 516 so long as the basic functions are retained, including the locking features discussed below and the level of insulation.

Receiving half 516 comprises a base 520, a perimeter wall 522 extending completely around base 520, and a spacer 524 abutting both base 520 and perimeter wall 522 to appropriately position connector 210 within receiving half 514.

Base 520 is substantially planer except for the raised conductor port holes 526 that extend away from base 520 in the opposite direction of perimeter wall 522. Conductor port holes 526 are substantially cylindrical elements with a plurality of distinct triangles 527 situated symmetrically around the entrance 528 to each conductor port hole 526. Each conductor port hole 526 corresponds to one conductor port 226 to provide access thereto for a conductor. Triangles 527 partially block entrance 528 and are attached to conductor port holes 526 along only one connecting side 529 as is known in the art.

Thus, when it is desired to insert a conductor, such as conductor 11 discussed above, into a conductor port 226, an electrician inserts the conductor 11 into a conductor port hole 526 through entrance 528. As conductor 11 passes into entrance 528, the tip of each of the triangles 527 bend inwardly due to the resiliency of the material of receiving member 514. This allows conductor 11 to pass through entrance 528 to conductor port 526. Upon the removal of conductor 11 from conductor port 26, as conductor 11 is removed from entrance 528, triangle 527 returns to its original shape, obstructing entrance 528.

Access to additional conductor ports 232 located at the bottom of lower arm 222 is achieved through additional conductor port holes 530 that are also located in base 520. However, additional conductor port holes 530 preferably do not protrude as cylinders as do port holes 526. Additional conductor port holes 530 are generally planer with base 520. Like conductor port holes 526, additional conductor port holes 530 employ triangles 531 that are symmetrically spaced in a circular fashion and attached to base 520 only at their respective one connecting side 532. Thus, triangles 531 function in the same manner as triangles 527 discussed above.

Alternatively, other port hole constructions can be use to provide access to conductor ports 226 and 233. For instance, removable caps may be employed that are in position when the ports are not in use, and removed when the ports are being used.

Perimeter wall 522 generally follows the outline of connector 210. Perimeter wall 522 also has a series of apertures that extend completely therethrough at various location around the perimeter. These apertures include set screw apertures 534, stud hole aperture 542, and locking aperture 550. All of these apertures 534, 542 and 550 are generally arch-shaped, they all extend only partially along the height of perimeter wall 522, and they all have a flat portion adjacent the junction point of perimeter wall 522 and base 520.

Set screw apertures 534 are positioned around perimeter wall 522 to correspond with the location of set screws 216, 228, and 234 on connector 210. Set screw apertures 534 vary in size depending upon the size of their respective set screw 216, 228, and 234 and the location thereof.

Each set screw aperture 534 has an end portion or apex 536 that faces towards base 520. On either side of apex 536 each set screw aperture 534 has two diverging side sections 538 that diverge from each other as they extend from apex 536 towards base 520.

Stud hole aperture 542 is similar to set screw apertures 534, but larger to accommodate stud hole 224 in connector 210. Stud hole aperture 542 has an end portion or apex 544 and two diverging side sections 546 that diverge from each other as they extend away from apex 544 towards base 520. Locking apertures 550 are also similar to set screw apertures 534, except smaller in size.

Inserting half 516 has a substantially planar and solid base 560 that is completely surrounding by a perimeter wall 562. Perimeter wall 562 has a free edge 564 opposite base 560, as well as an interior surface 566 and an exterior surface 568. Perimeter wall 562 generally takes the shape of connector 210 and is sized to fit within perimeter wall 522 of receiving half 514.

Perimeter wall 562 has a series of coupling assemblies at various location around the perimeter. These coupling assemblies include set screw hole coupling assemblies 570 and stud hole coupling assembly 580. These coupling assemblies 570 and 580 each have a trapezoidal projection and a arched opening.

Set screw hole coupling assemblies 570 are positioned to correspond with the location of set screws 216, 228, and 234 of connector 210. Each set screw hole coupling assembly comprises a trapezoidal projection 572 attached to exterior surface 568 and an arched opening 578. Each trapezoidal projection 572 has a curved base facing side 574 and two converging side walls 576 that converge towards each other as they extend from base 560 to side 574. Each projection 572 is positioned adjacent free edge 564 and extends towards base 560, but terminates prior to reaching base 560. Additionally, each projection 572 is positioned adjacent an arched opening 578 such that the apex 579 of each arched opening 578 is positioned flush with a curved base facing side 574 of a projection 572.

Stud hole coupling assembly 580 comprises an arch-shaped opening 582 and a trapezoidal projection 584 and is aligned to correspond with the location of stud hole 224 in connector 210. Stud hole coupling assembly 580 is substantially identical to each of the set screw hole coupling assemblies 570 discussed above except for its larger relative size. Accordingly, stud hole coupling assembly 580 will only be discussed briefly herein.

Perimeter wall 562 also has multiple trapezoidal locking projections 590 attached to exterior surface 568 adjacent free edge 564. These projections 590 are similar to projections 572 and 584 but without the curved base facing side 574. Projections 590 are purely trapezoidal.

Figure 12:
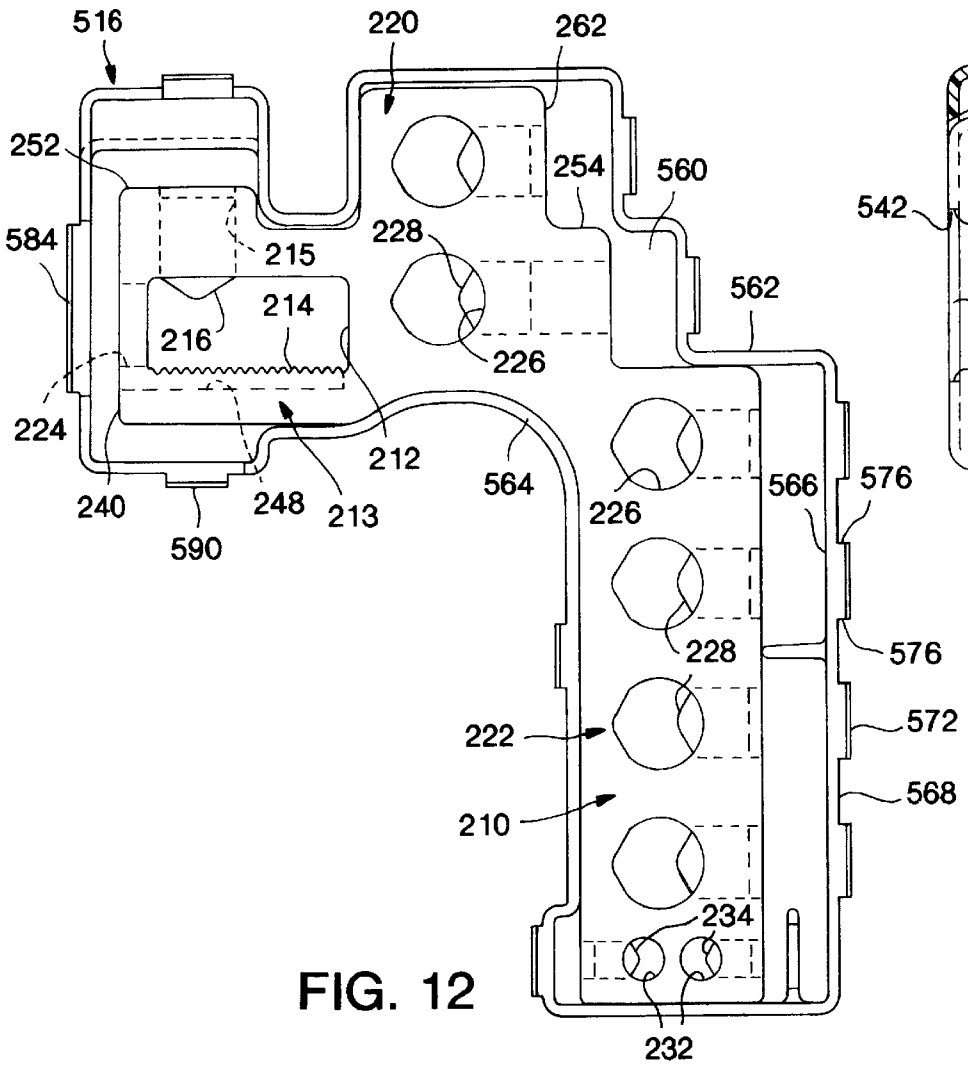
FIG. 12 is a side elevational view of the inserting half of the non-conductive cover in accordance with the present invention with the connector in accordance with the second embodiment of the connector of the present invention illustrated in side-elevational view and positioned within the inserting half of the cover.
Figure 15:
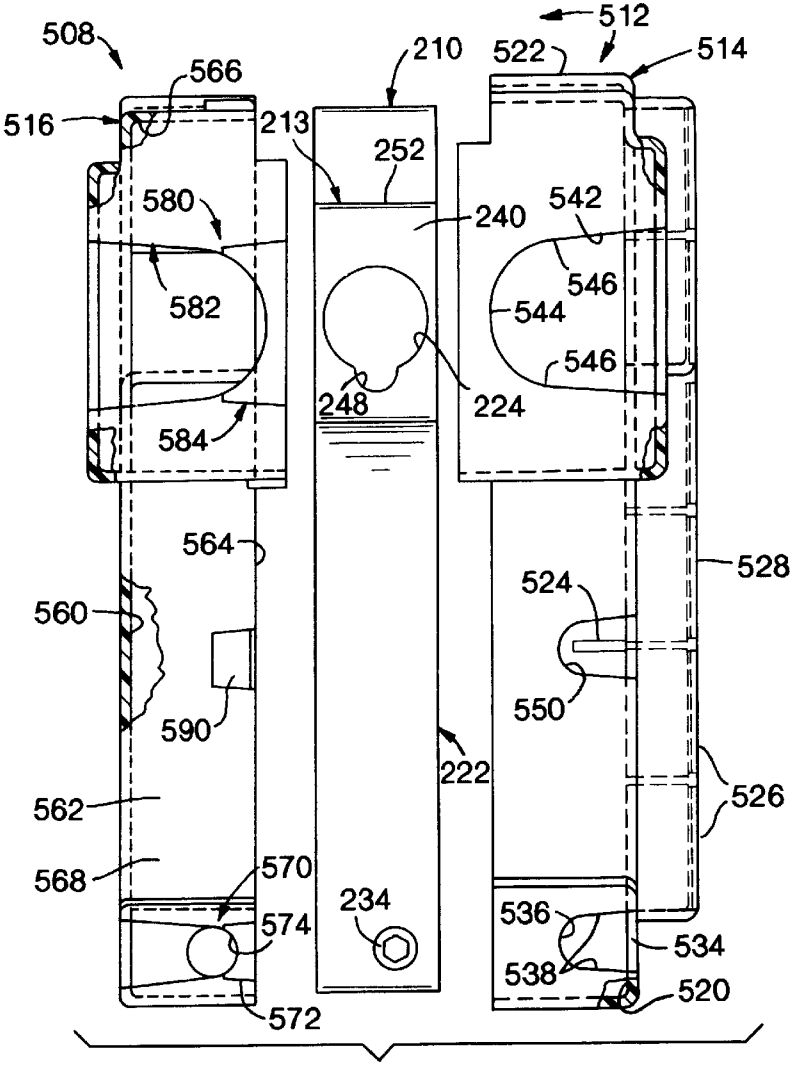
FIG. 15 is an exploded, rear elevational view of the non-conductive cover in accordance with the present invention, and the connector in accordance with the second embodiment of the connector of the present invention.
Figure 14:
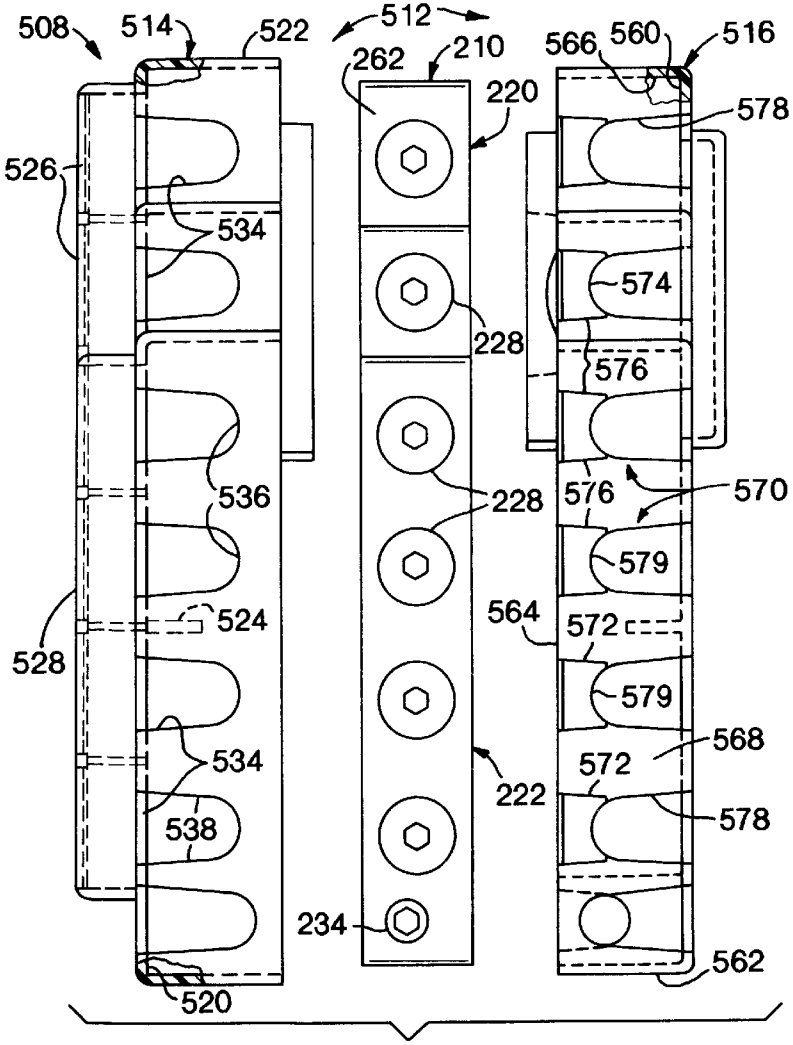
FIG. 14 is an exploded, front elevational view of the non-conductive cover in accordance with the present invention, and the connector in accordance with the second embodiment of the connector of the present invention.
Figure 17:
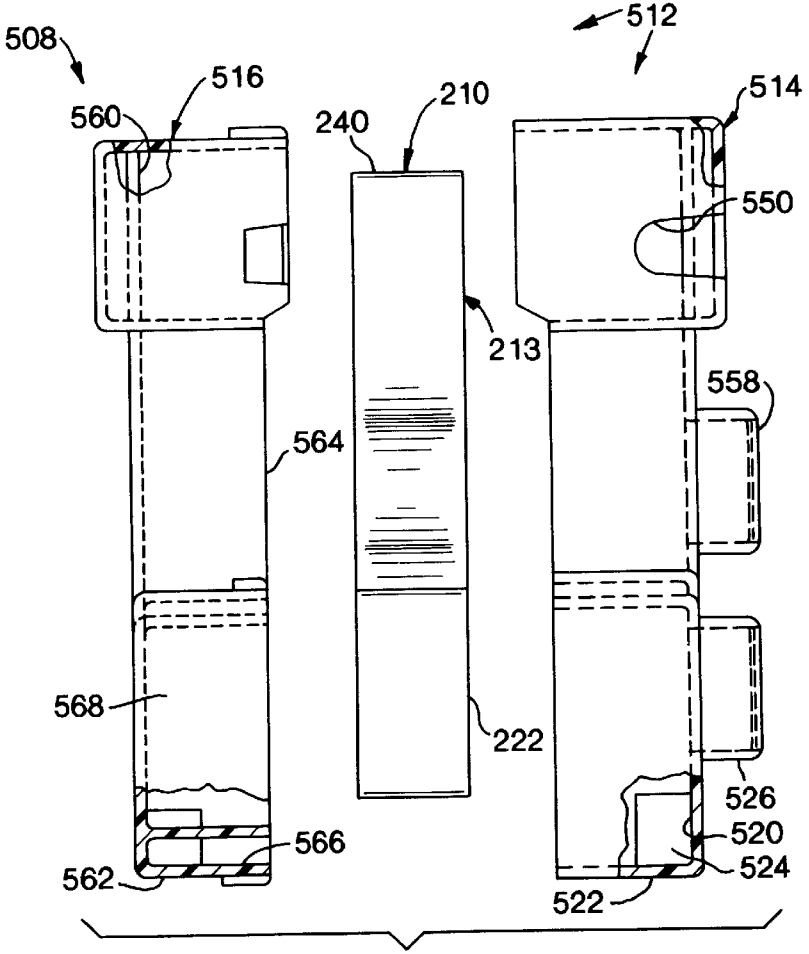
FIG. 17 is an exploded, bottom view of the non-conductive cover in accordance with the present invention, and the connector in accordance with the second embodiment of the connector of the present invention.
Figure 16:
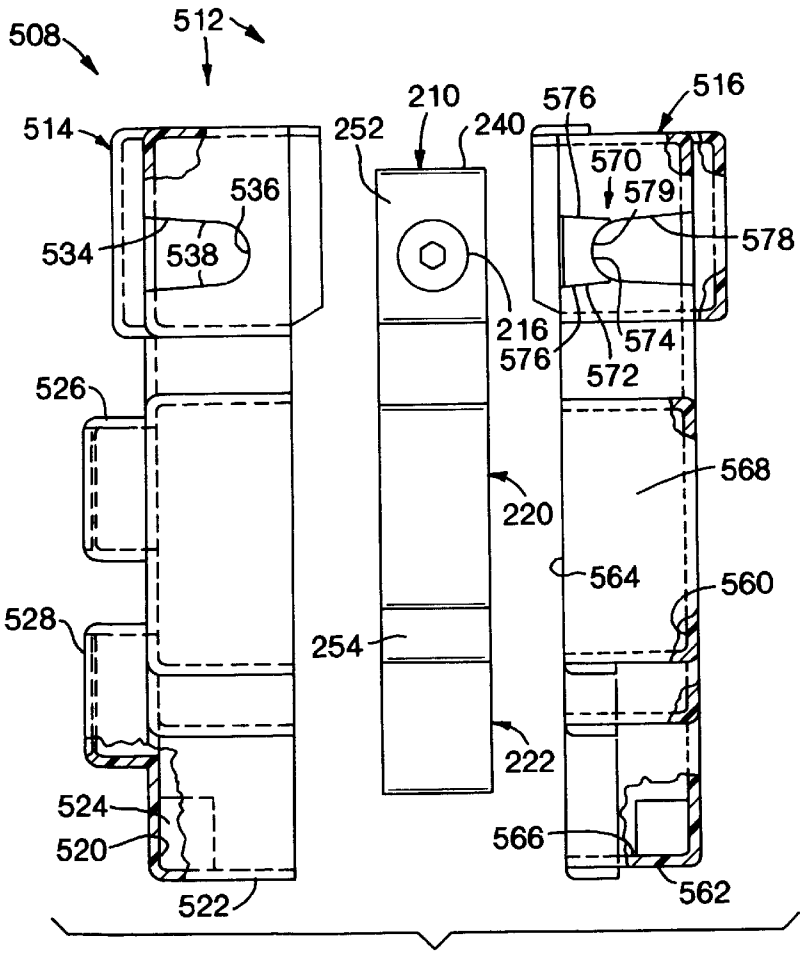
FIG. 16 is an exploded, plan view of the non-conductive cover in accordance with the present invention, and the connector in accordance with the second embodiment of the connector of the present invention.

As seen in FIG. 12, when constructing connector assembly 508, connector 210 is first received within inserting half 516. Then, inserting half 516 and connector 210 are inserted together into receiving half 514 until free edge 564 of perimeter wall 562 contacts base 520 and inserting half 516. When inserting half 516 is fully inserted into receiving half 514, the cover 512 is in the closed position and the resiliency of the receiving half 514 and the inserting half 516 enables the trapezoidal projection 572 of each set screw hole coupling assembly 570 to be inserted into a corresponding set screw aperture 534. The set screw apertures 534 and the set screw hole coupling assemblies 570 are sized such that diverging side sections 538 and converging side walls 576 mate and become flush with one another. This connection occurs at each set screw location and effectively locks receiving half 514 and inserting half 516 together.

A similar locking occurs between stud hole aperture 542 and stud hole coupling assembly 580 and between locking aperture 550 and trapezoidal locking projection 590 to produce a completely secure connection between receiving half 514 and inserting half 516.

The coupling of receiving and inserting halves 514 and 516 is accomplished by a snap-fit that occurs between each projection 572 and 590 with each aperture 534, 542 and 550. This snap-fit is possible due to the limited resiliency of both the receiving and inserting halves 514 and 516. Although a snap-fit is accomplished to join the halves 514 and 516 together, the rigidity of the material used to form halves 514 and 516 and the closeness of fit between halves 514 and 516 prevents an easy unsnapping of the fit. Preferably, the connection between halves 514 and 516 will only become undone upon the destruction of cover 512.

Figure 11:
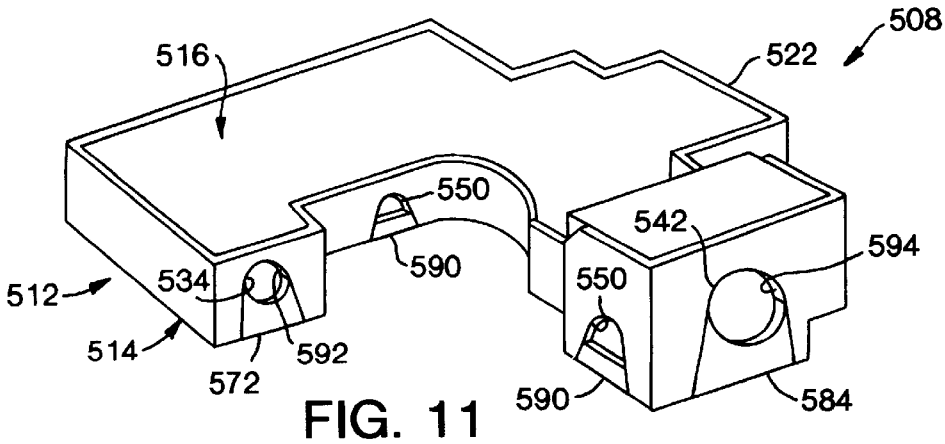
FIG. 11 is a front side perspective view of the connector assembly in accordance with the present invention illustrating the two halves of the non-conductive cover surrounding the connector in accordance with the second embodiment of the connector of the present invention.
Figure 13:
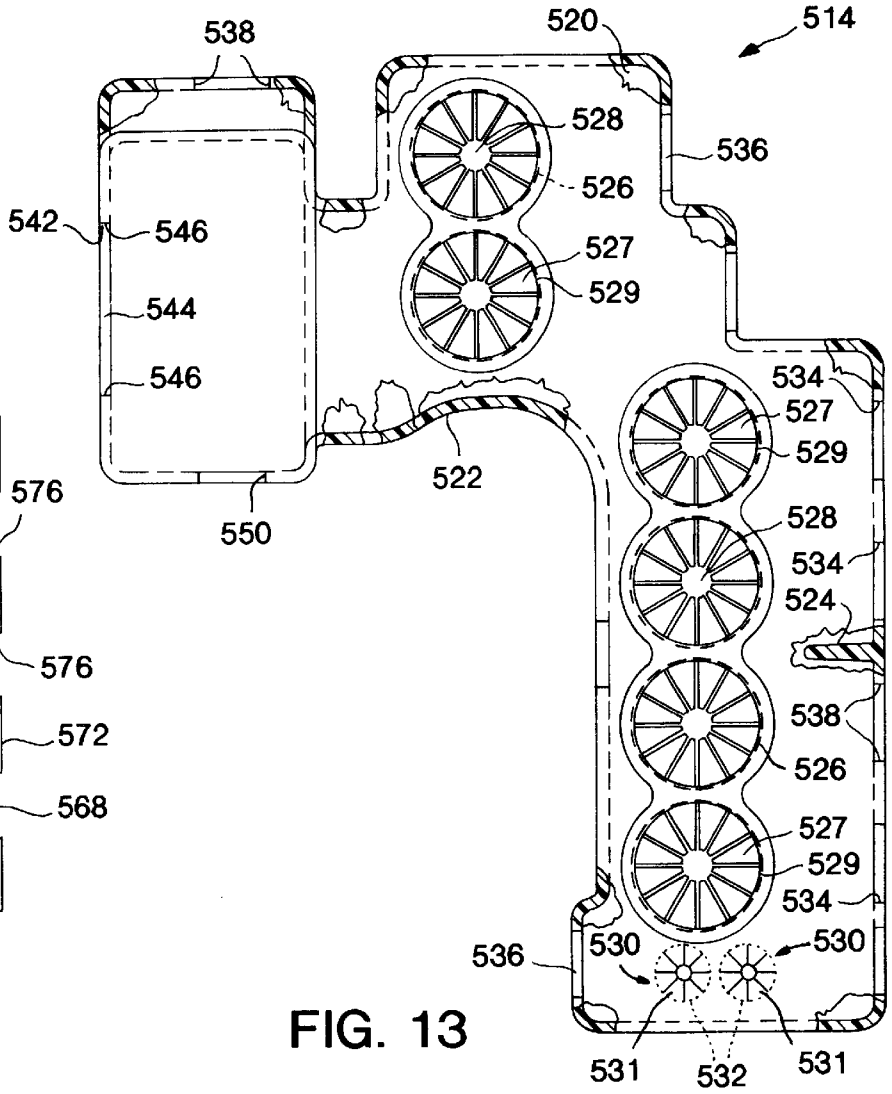
FIG. 13 is a side elevational view of the receiving half of the non-conductive cover in accordance with the present invention.

As seen in FIG. 11, in the completely closed position, receiving half 514 and inserting half 516 join to form substantially circular set screw holes 592, and a substantially circular stud hole 594. Set screw holes 592 are sufficiently large to allow set screws to pass therethrough and, likewise, stud hole 594 enables stud 4 to pass freely therethrough to connector 210. Each set screw hole 592 and stud hole 594 are formed half by a portion of an arched aperture 534, 542 and 550 of receiving half 514 and half by a portion of corresponding arched openings 578 and 582 of inserting half 516. This is a result of each the corresponding arches formed in cover 512 having the same radius of curvature.

While advantageous embodiments have been chosen to illustrate the invention, it will be understood by those skilled in the art that various changes and modifications can be made therein without departing from the scope of the invention as defined in the appended claims.

What is claimed is:

1. A connector comprising:

an attaching portion having a first axis extending in a first direction, a first free end facing a connecting direction opposite said first direction and adapted to receive a mating connection element, and a second end spaced from said first free end along said first axis; and a first arm portion coupled to and extending from said second end of said attaching portion and having a second longitudinal axis extending transversely to said first axis of said attaching portion, said first arm portion further having a plurality of first ports for receiving conducting devices, each of said first ports being open towards a second direction that is transverse to said second longitudinal axis, and said first arm portion and said attaching portion being integrally formed as a unitary, one-piece member; and a plurality of first fastening members, each of said first fastening members being coupled to one of said plurality of first ports for securing one of the conducting devices within each of said first ports, each of said first fastening members having a first actuating element that is accessible for manipulation in a third direction that is transverse to said second longitudinal axis and toward said connecting direction.

2. A connector comprising:

an attaching portion having a first axis extending in a first direction, a first free end adapted to receive a mating connection element, and a second end spaced from said first free end along said first axis; and a first arm portion coupled to and extending from said second end of said attaching portion and having a second longitudinal axis extending transversely to said first axis of said attaching portion, said first arm portion further having a plurality of first ports for receiving conducting devices, each of said first ports being open towards a second direction that is transverse to said second longitudinal axis, and said first arm portion and said attaching portion being integrally formed as a unitary, one-piece member; and a plurality of first fastening members, each of said first fastening members being coupled to one of said plurality of first ports for securing one of the conducting devices within each of said first ports, each of said first fastening members having a first actuating element that is accessible for manipulation in a third direction that is transverse to said second longitudinal axis, said second longitudinal axis extending substantially perpendicularly to said first axis of said attaching portion, said second direction extending substantially perpendicularly to said second longitudinal axis, and said third direction extending substantially parallel to and opposite to said first direction.

3. A connector according to claim 1, further comprising:

a second arm portion coupled to and extending from said first arm portion and having a third longitudinal axis extending transversely to said first axis of said attaching portion and spaced from and substantially parallel to said second longitudinal axis, said second arm portion further having a plurality of second ports for receiving conducting devices, each of said second ports being open towards said second direction, and said second arm portion, said first arm portion, and said attaching portion being integrally formed as a unitary, one-piece member.

4. A connector according to claim 2, further comprising:

a second arm portion coupled to and extending from said first arm portion and having a third longitudinal axis extending substantially perpendicularly to said first axis of said attaching portion and spaced from and substantially parallel to said second longitudinal axis, said second arm portion further having a plurality of second ports for receiving conducting devices, each of said second ports being open towards said second direction, and said second arm portion, said first arm portion and said attaching portion being integrally formed as a unitary, one-piece member.

5. A connector according to claim 4, further comprising:

a plurality of second fastening members, each of said second fastening members being coupled to one of said plurality of second ports for securing one of the conducting devices within each of said plurality of second ports, each of said second fastening members having a second actuating element that is accessible for manipulation in said third direction.

6. A connector according to claim 1, further comprising:

at least one third fastening member being coupled to said attaching portion for rigidly coupling the mating connection element to said first free end of said attaching portion.

7. A connector according to claim 6, wherein said at least one third fastening member has a third actuating element that is accessible for manipulation in a fourth direction that is substantially perpendicular to said first axis.

8. A connector according to claim 1, wherein each of said plurality of first fastening members is a set screw.

9. A connector according to claim 5, wherein each of said plurality of first and second fastening members is a set screw.

10. A connector according to claim 7, wherein said at least one third fastening member is a set screw.

11. A connector according to claim 5, wherein the number of said plurality of first ports is equal to the number of said plurality of second ports.

12. A connector according to claim 11, wherein said plurality of first ports comprises four ports and said plurality of second ports comprises four ports.

13. A connector according to claim 5, wherein the number of said plurality of first ports is less than the number of said plurality of second ports.

14. A connector according to claim 13, wherein said plurality of first ports comprises two ports and said plurality of second ports comprises four ports.

15. A connector comprising:

an attaching portion having a first axis extending in a first direction, a first free end adapted to receive a mating connection element, and a second end spaced from said first free end along said first axis; and a first arm portion coupled to and extending from said second end of said attaching portion and having a second longitudinal axis extending transversely to said first axis of said attaching portion, said first arm portion further having a plurality of first ports for receiving conducting devices, each of said first ports being open towards a second direction that is transverse to said second longitudinal axis, and said first arm portion and said attaching portion being integrally formed as a unitary, one-piece member; and a plurality of first fastening members, each of said first fastening members being coupled to one of said plurality of first ports for securing one of the conducting devices within each of said first ports, each of said first fastening members having a first actuating element that is accessible for manipulation in a third direction that is transverse to said second longitudinal axis, said first free end of said attaching portion having first and second spaced flanges being cantilevered from said second end of said attaching portion.

16. A connector according to claim 15, further comprising a hollow collar being slidable engagable with said attaching portion and extending completely around said attaching portion in a direction that is substantially perpendicular to said first axis of said attaching portion; and at least one third fastening member being coupled to said hollow collar and said attaching portion for rigidly coupling both said hollow collar and said attaching portion to the mating connection element.

17. A connector according to claim 16, wherein said third fastening member is a set screw.

18. A connector according to claim 16, wherein said second flange has a row of teeth thereon facing said first flange.

19. A connector comprising:

an attaching portion having a first axis extending in a first direction, a first free end adapted to receive a mating connection element, and a second end spaced from said first free end along said first axis; and a first arm portion coupled to and extending from said second end of said attaching portion and having a second longitudinal axis extending transversely to said first axis of said attaching portion, said first arm portion further having a plurality of first ports for receiving conducting devices, each of said first ports being open towards a second direction that is transverse to said second longitudinal axis, and said first arm portion and said attaching portion being integrally formed as a unitary, one-piece member; and a plurality of first fastening members, each of said first fastening members being coupled to one of said plurality of first ports for securing one of the conducting devices within each of said first ports, each of said first fastening members having a first actuating element that is accessible for manipulation in a third direction that is transverse to said second longitudinal axis, said attaching portion having an inner surface defining a hollow area for receiving the mating connection element, said inner surface having a row of teeth thereon, and said first free end of said attaching portion further having a substantially planar section that extends substantially perpendicularly to said first axis and having an opening in communication with said hollow area and extending completely though said planar section for receiving the mating connection element, and said attaching portion further having a third fastening member coupled thereto for rigidly coupling said attaching portion to the connection element, said third fastening member being positioned opposite to said row of teeth.

20. A connector according to claim 5, wherein said attaching portion and said first and second arm portions are formed of metallic material.

21. An electrical connecting assembly comprising:

a transformer connection element protruding from a transformer, said connection element having a first longitudinal axis extending in a first direction, a base end, and a projecting free end; and a connector coupled to said connection element and having an attaching portion and a first arm portion, said attaching portion being fastened to said free end of said connection element and said first arm portion being coupled to and extending from said attaching portion and having a second longitudinal axis extending transversely to said first longitudinal axis of said connection element, said first arm portion further having a plurality of first ports for receiving connecting devices, each of said plurality of first ports being open towards a second direction that is transverse to said second longitudinal axis, and a plurality of first fastening members, each of said plurality of first fastening members being coupled to one of said plurality of first ports for securing one of the connecting devices within each of said plurality of first ports, each of said first fastening members having a first actuating element that is accessible for manipulation in a third direction that is transverse to said second longitudinal axis and toward a connecting direction, which is opposite said first direction and toward said transformer connection element.

22. A connector according to claim 21, further comprising a second arm portion coupled to and extending from said attaching portion and having a third longitudinal axis extending transversely to said first longitudinal axis of said connection element and spaced from and substantially parallel to said second longitudinal axis, said second arm portion further having a plurality of second ports for receiving conducting devices, each of said plurality of second ports being open towards said second direction, and said second arm portion, said first arm portion, and said attaching portion being integrally formed as a unitary, one-piece member.

23. A connector according to claim 22, further comprising:

a plurality of second fastening members, each of said plurality of second fastening members being coupled to one of said plurality of second ports for securing one of the connecting devices within each of said plurality of second ports, each of said plurality of second fastening members having a second actuating element that is accessible for manipulation in said third direction.

24. A connector according to claim 23, wherein each of said plurality of first and second fastening members is a set screw.

25. A non-conductive cover, comprising:

a first member having a first base and a first perimeter wall extending from and around said first base, said first perimeter wall having at least one aperture extending completely therethrough, said at least one aperture being at least partially defined by a first end portion within said first perimeter wall and facing said first base;

a second member having a second base and a second perimeter wall extending from and around said second base, said second perimeter wall having a second interior surface and a second exterior surface with at least one coupling assembly comprising a projection and an opening in said perimeter wall, said projection having a first side facing towards and spaced from said second base and said opening extending completely through said perimeter wall and located between said second base and said first side of said projection; and said first member receiving said second member when said cover is in a closed position such that said second perimeter wall extends within said first perimeter wall and said projection being positioned within said at least one aperture, said first side of said projection being spaced from said first end portion of said first perimeter wall to permit access through both said first and second perimeter walls through a first hole formed by aligned portions of said first opening and said at least one aperture, and a cavity being formed between said first and second bases in said closed position.

26. A non-conductive cover according to claim 25, wherein said projection has two opposing and converging side walls converging towards said second base; and said at least one first aperture is further defined by two opposing and diverging side sections that diverge towards said first base; and said converging side walls and said diverging side sections couple and are flush with each other when said cover is in said closed position to secure said first and second members in said closed position.

27. A non-conductive cover according to claim 26, wherein said first hole is substantially circular.

28. A non-conductive cover according to claim 27, wherein said at least one coupling assembly comprises a plurality of coupling assemblies and said at least one aperture comprises a plurality of apertures, each of said plurality of apertures being coupled to one of said plurality of coupling assemblies to form a plurality of holes similar to said first hole when said first and second members are in said closed position.

29. A non-conductive cover according to claim 27, wherein each of said first member and said second member is integrally formed as a unitary, one-piece member.

30. A non-conductive cover according to claim 29, wherein each of said first and second members is formed of low density polyethylene.

31. A connecting assembly comprising:

a connector having an attaching portion and a first arm portion, said attaching portion having a first axis extending in a first direction, a first free end adapted to receive a mating connection element, and a second end spaced from said first free end along said first axis, said first arm portion coupled to and extending from said second end of said attaching portion and having a second longitudinal axis extending transversely to said first axis of said attaching portion, said first arm portion further having a plurality of first ports for receiving conducting devices, each of said first ports being open towards a second direction that is transverse to said second longitudinal axis, and said first arm portion and said attaching portion being integrally formed as a unitary, one-piece member, said connector further having a plurality of first fastening members, each of said plurality of first fastening members being coupled to one of said plurality of first ports for securing one of the conducting devices within each of said plurality of first ports, each of said plurality of first fastening members having a first actuating element that is accessible for manipulation in a third direction that is transverse to said second longitudinal axis; and a non-conductive cover having first and second members that surround said connector when said cover is in a closed position, said first and second members being distinct and separate members that couple together to form a plurality of first holes when said cover is in said closed position, each of said plurality of first holes extending completely through a portion of said first and said second members and being aligned with one of said first fastening members, said first member also having a plurality of second holes, each of said plurality of second holes being aligned with one of said plurality of first ports.

32. A connecting assembly according to claim 31, wherein said first member of said cover has a first base and a first perimeter wall extending from and around said first base, said first perimeter wall having a plurality of apertures extending completely therethrough, each of said plurality of apertures being at least partially defined by one of a plurality of first end portions within said first perimeter wall and facing said first base, and said second member of said cover has a second base and a second perimeter wall extending from and around said second base, said second perimeter wall having a second interior surface and a second exterior surface with a plurality of coupling assemblies, each of said plurality of coupling assemblies comprising a projection and an opening in said second perimeter wall, each said locking projection having a first side facing towards and spaced from said second base and each said opening extending completely through said second perimeter wall and located between said second base and one of said second sides, respectively, and said first member receiving said second member when said cover is in said closed position such that said second perimeter wall extends within said first perimeter wall and each of said projections is positioned within one of said plurality of apertures, such that aligned portions of each of said openings and each of said plurality of apertures form said plurality of first holes.

33. A connecting assembly according to claim 32, wherein said second longitudinal axis extends substantially perpendicularly to said first axis of said attaching portion, said second direction extends substantially perpendicularly to said second longitudinal axis, and said third direction extends substantially parallel to and opposite to said first direction.

34. A connector according to claim 1, wherein at least one of said first fastening members selectively moves along an engagement axis, which is substantially parallel to said first axis.

35. An electrical connecting assembly according to claim 21, wherein at least one of said first fastening members selectively moves along an engagement axis, which is substantially parallel to said first axis.

* * * * *